United States Patent [19]

Soltermann et al.

[11] Patent Number: 4,775,963

[45] Date of Patent: Oct. 4, 1988

[54] ANALOG WATCH HAVING TWO MOTORS AND COMPRISING MEANS FOR PERPETUALLY INDICATING THE DAY OF THE MONTH

[75] Inventors: Bertrand Soltermann, Diesse; Schmidli Pierre, Evilard, both of Switzerland

[73] Assignee: ETA SA Fabriques d'Ebauches of Granges, Switzerland

[21] Appl. No.: 103,249

[22] Filed: Oct. 1, 1987

[30] Foreign Application Priority Data

Oct. 15, 1986 [CH] Switzerland ..... 04122/86

[51] Int. Cl.[4] ..... G04B 19/24

[52] U.S. Cl. ..... 368/31; 368/34; 368/28; 368/204

[58] Field of Search ..... 368/28, 31, 34, 204, 368/28-40, 203, 204

[56] References Cited

U.S. PATENT DOCUMENTS 4,300,222 11/1981 Nitta ..... 368/37
4,695,168 9/1987 Meister et al. ..... 368/31

FOREIGN PATENT DOCUMENTS 2394840 1/1979 France .
3247910 6/1984 Fed. Rep. of Germany .
534913 8/1972 Switzerland .

OTHER PUBLICATIONS

Patent Abstracts of Japan, vol. 7, No. 127 (P-201)[1272], 3 juin 1983; and JP-A-58 45 589 (Chino Seisakusho K.K.) 16-03-1983.

Patent Abstracts of Japan, vol. 2, No. 106, 31 auot 1978, p. 5563 E 78; and JP-A-53 70 866 (Daini Seikosha K.K.) 23-06-1978.

*Primary Examiner*—Bernard Roskoski
*Attorney, Agent, or Firm*—Pollock, Vande Sande & Priddy

[57] ABSTRACT

The watch has a first motor for driving a time display, a second motor for driving a numerical indicator of the day of the month, a perpetual-calendar circuit, a first transmission circuit, a non-volatile memory, a second transmission circuit, an initialization circuit and a detection circuit for generating a signal when the cell that energizes the circuit is being replaced. The calendar circuit includes day, month, and year counters. The contents of the month and year counters are transferred to the non-volatile memory by the first transmission circuit in response to periodic signals. The date on which the watch stops at the end of the cell's life is memorized by the day of the month indicating means and the non-volatile memory. Upon insertion of a new cell and in response to the detection signal, the contents of the non-volatile memory are transferred into the month and year counters by the second transmission circuit. The day counter is put into agreement with the day of the month indicator upon date setting the watch with the aid of the initialization circuit.

7 Claims, 3 Drawing Sheets

ANALOG WATCH HAVING TWO MOTORS AND COMPRISING MEANS FOR PERPETUALLY INDICATING THE DAY OF THE MONTH

BACKGROUND OF THE INVENTION

1. Field of the Invention

This invention relates to an analog electronic watch having two motors, one for driving the time display, the other for driving means for numerically displaying the day of the month, and is more particularly concerned with a watch comprising, in addition, a perpetualcalendar circuit. This circuit includes day, month and year counters and issues a date-representing signal to a control circuit which activates the second motor and causes it to move forward by a number of steps such that the numerical display of the day of the month may be made to correspond to the contents of the day counter, and thus agree with the date shown by a perpetual calendar.

2. Prior art

Such watches are known and a form of embodiment thereof is described in U.S. Pat. No. 4,300,222. The watch described in this specification comprises a perpetual calendar displaying the day of the month and, possibly, the day of the week. Although the calendar is reliable when the watch operates normally, a change of cell causes the counters to be in states that are in no way related to the date since the calendar circuit is no longer able to generate correct signals.

After a change of cell, the counters, the day of the month display and the time display of the watch need to be corrected. Correcting the day of the month display is done in the usual way. However, correcting the counters is hardly possible for the user or for a watch-repairer not having the required equipment. Indeed, to diminish the time spent, each counter must be corrected separately and this involves complex manipulations. Moreover, for such correction to be possible, the contents of the counters must be known and this information is not displayed by the watch.

A change of cell can therefore only be performed in the factory or in an after-sales service center and this places an undesirable constraint in the use of an otherwise most practical watch.

SUMMARY OF THE INVENTION

An object of the invention is to overcome this drawback by providing a watch having a perpetual calendar that only involves, after a change of cell, an easy correction of the day of the month display by the bearer of the watch.

To this end, the watch provided by the invention comprises:

a time-keeping circuit able to generate a time base signal and a rapid advance signal having a higher frequency than the time base signal;

a first motor arranged to be activated off the time base signal;

a daily contact arranged to be activated by the first motor at the end of each day to issue a daily signal;

analog hour display means arranged to be driven by the first motor;

a corrector member having an inoperative position and an operative position in which the indications given by the hour display means may be corrected;

means coupled with the corrector member and arranged to generate a logic positioning signal, with one level of said signal being representative of the inoperative position of said member and the other level being representative of the operative position of said member;

a perpetual calendar circuit including day, month and year counters connected in series and activatable by the daily signal, and means responsive to the state of the month and year counters to put the day counter, at the end of 31-day months, in a state corresponding to the first day of the following month, in which state the day counter is arranged to generate a monthly signal;

a second motor;

analog day of the month display means arranged to be driven by the second motor;

means activatable by the second motor to generate a day of the month signal whenever the day of the month is the first day of a month;

a circuit for controlling the second motor and arranged to issue to the latter, in response to the daily signal, to the monthly signal, to the day of the month signal and to the rapid advance signal, a control signal to enable the second motor to alter, at the frequency of the rapid advance signal, the day of the month display by a number of days such as to make up to 32 the state of the day counter; and a cell for energizing the electronic circuitry; said watch further comprising:

a reprogrammable non-volatile memory;

a first transmission circuit coupled to the month and year counters to transfer into the non-volatile memory the contents of said counters at the end of each month and of each year respectively;

a detection circuit arranged to generate a detection signal upon replacement, on a replacement date, of the cell that caused the watch to stop on a stoppage date;

a second transmission circuit for transferring, in response to the detection signal, the contents of the non-volatile memory into the month and year counters; and an initialization circuit arranged to receive the detection signal, the day of the month signal, the positioning signal, the rapid advance signal and the signal that is representative of the contents of the day counter and to issue, in response to the positioning signal generated by the motion of the corrector member from its operative to its inoperative positions after correcting the day of the month displayed by said analog means, a discrimination signal to the month counter such as to increment the latter by one unit when the day of the month on which the cell is replaced is less than the day of the month on which the watch stopped whereby the month counter may indicate the correct month should the cell be replaced within twenty-seven, twenty-eight, twenty-nine or thirty days reckoned from the date of stoppage of the watch.

One advantage of the invention is that, after a change of cell, inasmuch as it is performed within one month from the date of stoppage of the watch, the perpetual calendar circuit may be made to operate again correctly by merely correcting the numerical indication of the day of the month that is shown, a simple manipulation that can be done by the user in the same way as with ordinary calendar-watches.

Another advantage of the invention is that it does not require the contents of the day counter in the non-volatile memory to be memorized, thereby enabling the area of the memory to be reduced, its consumption to be decreased and its life to be increased.

SHORT DESCRIPTION OF THE DRAWINGS

FIGS. 1, 2 and 3 together show, in essentially block diagram form, a preferred embodiment of the watch provided by the invention, references a, b, c, . . . , m indicating cross-over points between conductors extending from one figure to another.

DETAILED DESCRIPTION

Figure 1:
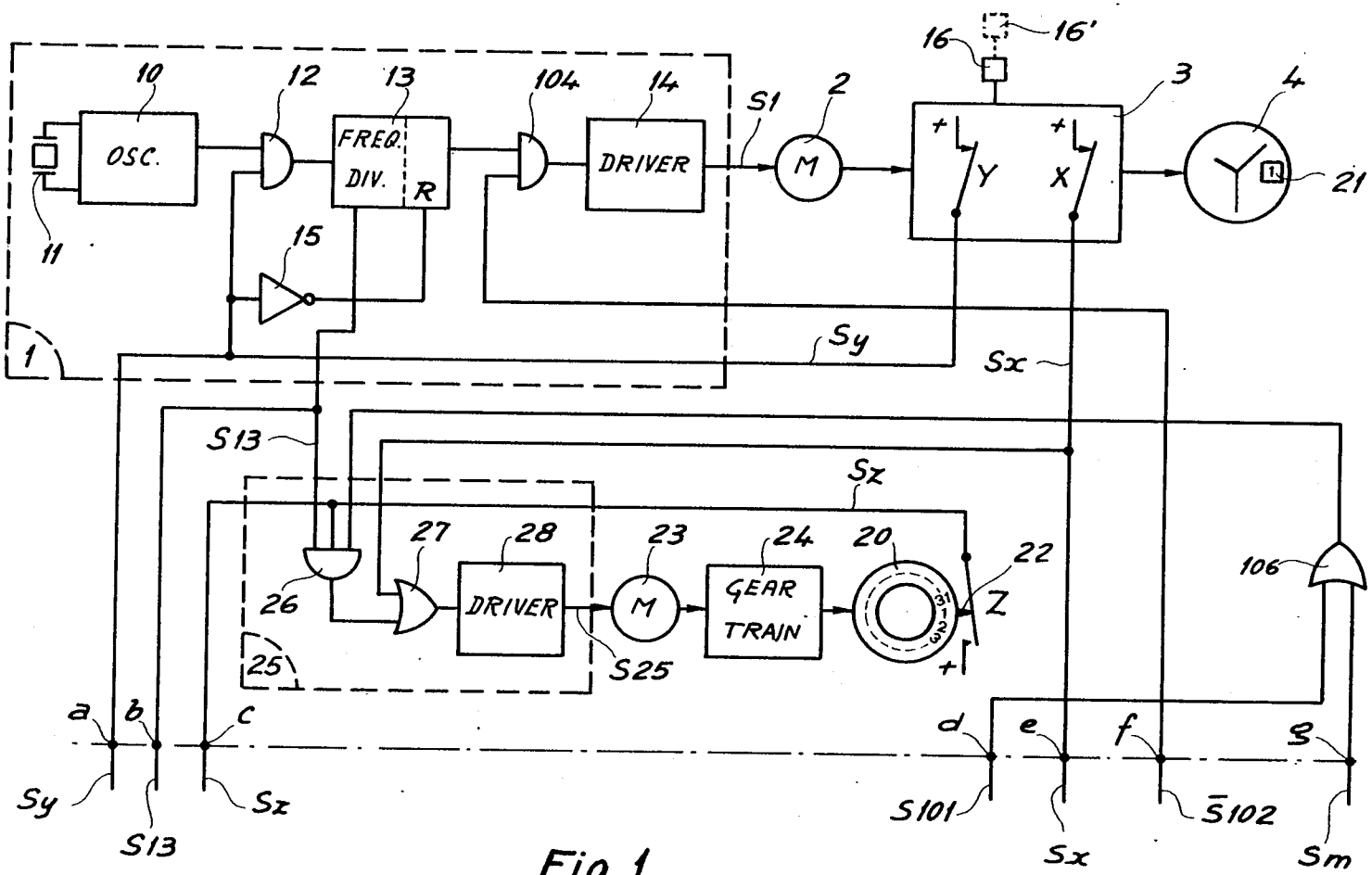

The illustrated watch comprises a time-keeping circuit 1 which supplies a clock signal S1 to a first motor 2 which, via a control mechanism 3, drives a time display 4 having hour, minute and second hands.

Time-keeping circuit 1 includes an oscillator 10 that generates a signal of e.g. 32768 Hz and whose frequency is stabilized by a quartz resonator 11, a two-input AND gate 12 having one input connected to the output of the oscillator, a frequency divider 13 having a first input connected to the output of AND gate 12, a two-input AND gate 104 having one input connected to a first output of divider 13 that issues a 1 Hz signal, and a drive circuit 14 which receives the 1 Hz signal from the output of AND gate 104 and issues signal S1 on its own output. Frequency divider 13 further has a second output which issues a rapid advance or retrieval signal S13 having a frequency of about 10 Hz, and a reset input R connected to the output of an inverter 15 whose input is connected to the second input of AND gate 12.

Motor 2 may for instance be a stepping motor that rotates in one direction only. It drives, in control mechanism 3, a first gear-train, not shown, which causes the hands of display 4 to move forward. This gear-train also actuates a first, daily contact X, causing it to close when the watch moves on to the next day, i.e. at midnight, in order to generate a daily logic signal Sx. It will be assumed that signal Sx is low when contact X is open and high when closed. The same applies to signals generated by other contacts described later.

Control mechanism 3 further comprises correction means, not shown, for resetting the watch by means of a corrector member, e.g. a time-setting crown 16 shown in an inner, neutral position. Crown 16 may be moved to an outer, correction position 16' in which it is mechanically coupled with the hands, enabling the indications of display 4 to be corrected in a conventional manner.

Crown 16 further acts, irrespective of its angular position, on a second, position contact Y that generates a logic signal Sy which is applied to the second input of AND gate 12. Contact Y is closed when crown 16 is in the neutral position, and open when crown 16 is in the correction position.

The components described so far are those of a conventional analog watch that operates as follows. When crown 16 is in its inner, neutral position, with signal Sy high, AND gate 12 lets the signal from oscillator 10 through to frequency divider 13. The reset input R of divider 13 being low, the circuit issues the 1 Hz signal to the input of drive circuit 14 via AND gate 104 whose other input is assumed to be high for the time being. Circuit 14 in turn issues clock signal S1 to motor 2. Motor 2 drives, via the first gear-train, the hands of time display 4 and actuates contact X by means of this gear-train. The daily signal Sx generated by contact X switches of midnight from low to high and returns shortly afterwards to low where it remains until the beginning of the following day.

In the outer, correction position 16' of crown 16, signal Sy is low, thus blocking AND gate 12 and resetting via inverter 15 frequency divider 13 which, in these conditions, receives no signal. The same applies to motor 2, which remains idle. The hands of display 4 can then only be moved by crown 16 which, in this position 16', is connected to the gear-train to enable accurate time-setting of the watch. When the hands, driven by crown 16, go through the midnight point, contact X is of course actuated as if the hands were driven by motor 2.

The watch further comprises a perpetual day of the month indicator giving the number of each day of a month. This information is provided by a day of the month display 20 embodied in the usual way by a disc bearing numbers 1 to 31. In FIG. 1, display 20 is separate from display 4, but in practice the day of the month will appear in an aperture 21 of time display 4.

Display 20 further actuates a contact Z on the first day of each month, as by means of a cog 22 provided on the disc opposite number 1. Contact Z generates a first day of the month signal Sz which goes high at the start of the first day of each month and which reverts to low one day later so to remain till the beginning of the next month.

Disc 20 is driven forward at the start of each new day by a second unidirectional motor 23 which drives disc 20 via a second geartrain 24, and motor 23 is activated by a control signal S25 generated by a control circuit 25.

Circuit 25 comprises a three-input AND gate 26, a two-input OR gate 27 having one input connected to the output of AND gate 26, and a drive circuit 28 connected to the output of gate 27 and which issues on its output, control signal S25. One input of AND gate 26 receives rapid advance signal S13, a second receives first day of the month signal Sz, and a third receives a monthly signal Sm, described later. The second input of OR gate 27 receives daily signal Sx.

Figure 2:
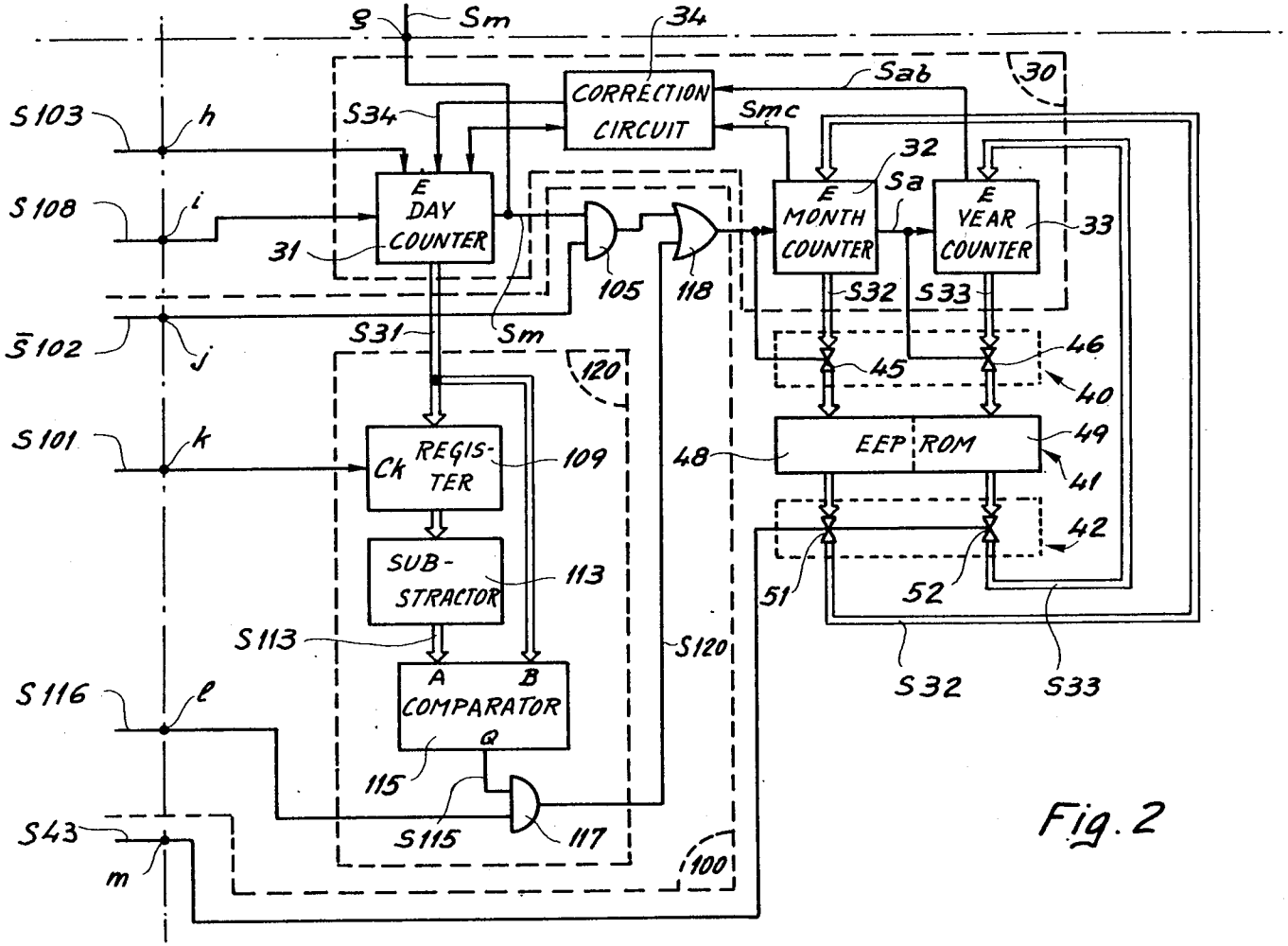
Figure 3:
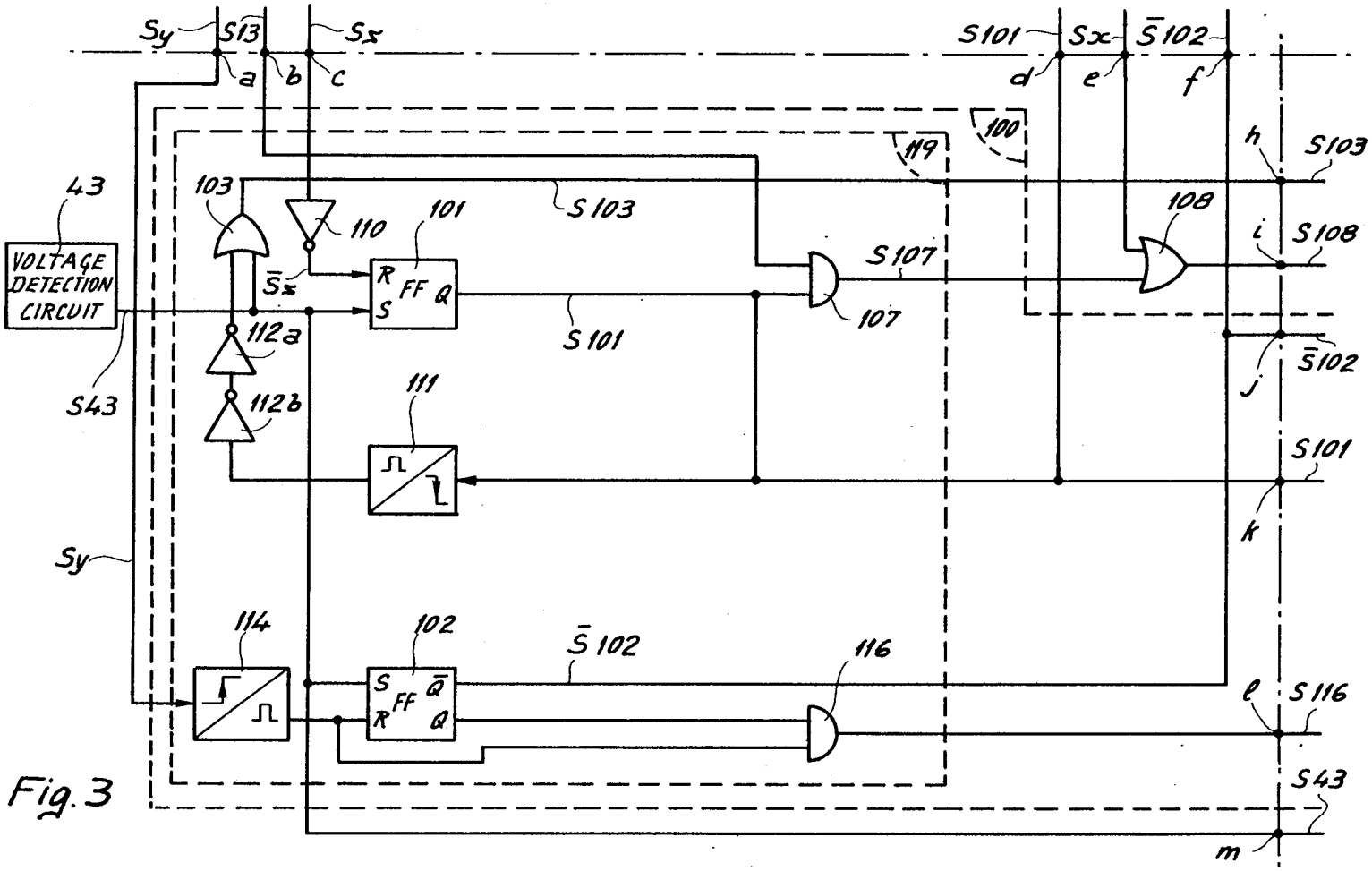

The watch further comprises (FIG. 2) a perpetual calendar circuit 30 having a five-bit day counter 31 which counts in thirty-ones, a four-bit month counter 32 which counts in twelves, and two-bit year counter 33 which counts in fours. The input of counter 33 is connected to the output of counter 32 and it will be assumed for the time being that the input of counter 32 is directly connected to the output of counter 31. Counter 31 receives on its counting input daily signal Sx and issues on one output, at the beginning of each month, monthly signal Sm to counter 32 which, in turn, issues at the beginning of each year an annual signal Sa to counter 33. Signal Sx is applied to counter 31 via a two-input OR gate 108, one input being connected to contact X and the other being assumed to be low for the time being. Each counter further issues, on another input, a signal indicative of its contents, i.e. S31 for counter 31, S32 for counter 32 and S33 for counter 33. Additionally, counter 32 issues a signal Smc indicative of short months of less than thirty-one days and counter 33 issues a signal Sab indicative of a leap year in a four-year cycle.

Circuit 30 further has a correction 34 which receives signals Smc and Sab. Circuit 34 generates, from signals Smc and Sab, a correction signal S34 for counter 31 to set its contents to 1 when the calendar switches from a short month to the following month. In this way, the contents of counter 31 will always agree with what is shown by a perpetual day of the month indicator.

The switch to 1 of the contents of counter 31 generates signal Sm. It will be assumed that this signal is normally low and goes high at midnight, when the calendar circuit moves from one month to the next, and reverts to low at the latest one day later.

Signals S31, S32 and S33 together make up an eleven bit calendar signal S30 representative of the date in counters 31, 32 and 33. Each of these counters further has an input E for setting them, with a logic signal, to a given day, month and year respectively. This date setting can however only be done at the factory.

Circuit 30 will not be described in detail since such circuits are known and a form of an embodiment thereof is described in the U.S. Patent specification referred to earlier.

Monthly signal Sm is applied to the third input of AND gate 26 in control circuit 25 via a two-input OR gate 106, one input receiving signal Sm and the other receiving a logic signal which will be assumed for the time being to be low. Under these conditions circuit 25 operates as follows. Assuming disc 20 and calendar circuit 30 have been set to the correct date, daily signal Sx, which reaches at midnight the input of drive circuit 28 via OR gate 27, causes disc 20 to move forward by one day. This same signal also increments by one unit day counter 31. If disc 20 and day counter 31 show a day other than the last day of a month, signals Sz and Sm will respectively be high and low. Rapid advance signal S13 will in this case be blocked by AND gate 26 through signal Sm. Disc 20, having rotated through one step, will thus remain in this position until contact X is closed again. But if disc 20 shows the 30th day of a thirty-day month, signal Sx at midnight will cause disc 20 to rotate to 31 and the contents of day counter 30 to switch to 1. Signal Sm then goes high, which is the same logic level as signal Sz since contact Z is closed for this position of disc 20. It is assumed that rapid advance signal S13 is made up of pulses and has a frequency of say 8 Hz. This signal can, under these conditions, transit through AND gate 26 and OR gate 27 and reach circuit 28. In response to each pulse of signal S13, circuit 28 generates a signal that causes disc 20 to move forward by one day. In the present case, with disc 20 indicating 31, a single pulse of signal S13 is sufficient to move disc 20 to 1 and to bring it into agreement with the contents of counter 31. In this new position of disc 20, contact Z is open and signal Sz is low. This causes signal S13 to be blocked by AND gate 26. Disc 20 will therefore remain in this position until the next daily signal Sx, which will cause disc 20 and the contents of counter 31 to go to 2. In these states of disc 20 and of counter 31, signal Sz is high, contact Z being closed, and signal Sm is low. Signal Sm thus causes signal S13 to be blocked by AND gate 26 until the contents of counter 31 again are 1.

The same thought process would show that at the end of a twenty-nine day month of February in a leap year, AND gate 26 of control circuit 25 would allow two consecutive pulses of rapid advance signal S13 to go through, causing disc 20 to rotate rapidly, at the frequency of this signal, from 30 to 1. And at the end of a twenty-eight day month of February, three pulses of the rapid advance signal S13 would cause disc 20 to rotate from 29 to 1.

Besides the above described function of contact Z, the latter further enables, in the event of a malfunction of disc 20, to synchronize the latter with the contents of day counter 31 on the first day of each month. This is due to the fact that, whatever indication is provided by disc 20 when the contents of day counter 31 are 1 and monthly signal Sm is high, AND gate 26 will allow the required number of pulses of rapid advance signal S13 to transit through it in order rapidly to rotate disc 20 to the first day of the month.

Drive circuit 28 issues on its output control signal S25 whenever a signal issues on the output of OR gate 27. The duration of this latter signal therefore does not affect control signal S25. Thus, if a pulse of rapid advance signal S13 is interrupted and shortened through contact Z being opened, disc 20 will still rotate normally.

To move disc 20 by one day, control signal S25 may contain only one pulse causing motor 23 to rotate one step. However, to reduce the torque that needs to be suppied by the motor and lower its consumption, it is preferred for disc 20 to be rotated by driving motor 23 through W steps in response to a control signal S25 made up of a series of W consecutive pulses. The triggering of one pulse of a series automatically generates the other pulses in the series, such that disc 20 can only move through whole days.

Control circuit 25 can also be designed to generate the control signal S25, that causes disc 20 to advance by the required number of days at the end of a month of less than thirty-one days, on the basis of the information supplied by signals Smc and Sab, instead of that supplied by signal Sz. An embodiment of such a circuit is described, for example, in the U.S. Patent specification mentioned earlier. Contact Z then serves no purpose. This arrangement however has the drawback of not enabling disc 20 in the case of a malfunction of the latter to be synchronized with the contents of counter 31 on the first day of each month.

The circuits of the described watch are supplied with energy by a cell not shown. After initially time and date setting the watch the latter will carry on showing the correct time so long as the voltage of the cell remains above a critical threshold.

After a while, as the cell runs out, its voltage drops below the critical threshold and the watch will stop on a date $D_A$. This stoppage entails the loss, and this is important, of the date contained in counters 31, 32 and 33 of calendar circuit 30 since these counters form a memory which is cleared when it no longer receives sufficient energy. Replacement of the used cell by a new cell does not, of course, enable this date to be recovered since the counters are then in random states, or in a state in no way related with the date on which the watch stopped, such date continuing however to appear on disc 20.

When the cell is replaced on a date $D_R$, the counters thus need to be reprogrammed. This is a complex operation requiring the watch to be sent back to the factory, a major inconvenience.

To avoid this drawback, the watch further comprises a first transmission circuit 40, a reprogrammable non-volatile memory 41 also referred to as EEPROM and which retains its contents even in the absence of a supply voltage, a second transmission circuit 42, a voltage detection circuit 43 and an inititalization circuit 100.

Transmission circuits 40 and 42 can, for instance, be made up of transmission gates which are known electronic components, while non-volatile memory 41, with its interface circuits that enable items of information to be entered and read, can with advantage be of the FAMOS type, also known. The use of such a memory in the watchmaking art is known as for instance in Swiss Patent Specification No. 534913 which describes a frequency correction logic circuit wherein the content of the non-volatile memory governs the operation of a watch. It should however be noted that the area occupied by a non-volatile memory with its interface elements in a horological circuit is quite substantial, that its energy consumption when entering and reading data is not negligible and, above all, that the duration of memorization decreases rapidly with the number of entries and readings made.

The purpose of the non-volatile memory is to safeguard the contents of the counters in calendar circuit 30 when a cell runs out. The best way would be to transfer to this memory the content of day counter 31 at the end of each day, the content of month counter 32 at the end of each month and the content of year counter 33 at the end of each year. However, the part of the non-volatile memory that is connected to the day counter would then have to work at too high a frequency for the watch to have a sufficiently long life.

To overcome this difficulty, only the contents of the month and year counters are periodically transferred into the non-volatile memory in the present embodiment. This has the added advantage of reducing the capacity of the memory from 11 bits to 6 bits and hence of reducing its area by nearly half.

The purpose of first transmission circuit 40 is to transfer the contents of the counters 32 and 33 from calendar circuit 30 to non-volatile memory 41 in response to a transfer signal. To this end, circuit 40 comprises a first series 45 of four transmission gates. These gates are connected, firstly, to the output of counter 32 so as to receive the four-bit signal S32 and, secondly, to the input of a first, four-bit section 48 of memory 41. These gates are controlled by the transfer signal which in this case is monthly signal Sm.

Thus, at the end of each month when the content of counter 32 changes, the new value of counter 32 is transferred to section 48 of memory 41, in which it remains memorized irrespective of the voltage of the cell.

Second transmission circuit 42 has the same structure as circuit 40. It thus also has a first series 51 of four transmission gates. These gates are connected, firstly, to the output of section 48 of memory 41 so as to receive signal S32 and, secondly, to the input E of counter 32.

When changing the cell on date $D_R$, circuit 43, which is a monostable flip-flop of a known type, generates a detection signal S43 which indicates that the voltage across the terminals of the circuits is again at least equal to the critical threshold. This signal is taken as the transfer signal for second transmission circuit 42. Thus, at that instant, when the state of counter 32 is indefinite, counter 32 receives on its input E the signal S32 that existed at the time the watch stopped on date $D_A$.

Circuit 40 further comprises a second series 46 of two transmission gates for transferring, at the end of each year in response to signal Sa, the content of counter 33 to a second, two-bit section 49 of memory 41. Circuit 42 also comprises a second series 52 of two transmission gates which are connected, firstly, to the output of section 49 and, secondly, to input E of counter 33, signal S43 being taken as the transfer signal for these gates as with the gates of series 51.

Thus, just after changing the cell on date $D_R$, month counter 32 and year counter 33 are reset, by signal S43 and with the aid of circuit 42, in the state they were in when the watch stopped on date $D_A$, whereas the state of day counter 31 becomes indefinite. Disc 20 remains of course in the position it was in on date $D_A$.

In order for the watch's calendar again to display the correct date after a change of cell, month counter 31 must first be put into agreement with day of the month display disc 20, whereupon counter 31 and disc 20 are set manually to the day of the month of date $D_R$.

Counter 31 and disc 20 are brought into agreement with one another automatically with the aid of initialisation circuit 100 after the change of cell. Circuit 100 also ascertains whether the new cell was put in during the same month the watch stopped or the month after and, in the latter event, it increments counter 32 by one unit so that its content should reflect the correct month.

In bringing day counter 31 into agreement with disc 20, initialization circuit 100 plays a part similar to that of a hypothetical, additional, five-bit section for non-volatile memory 41, which, by means of transmission gates, would memorize the content of counter 31 when the watch stops and would transfer this information to this counter after the change of cell. Circuit 100, which is made up of conventional logic circuits, has however the advantage over a five-bit non-volatile memory of taking up less room, of needing less energy and of having no life limitation.

Whether the watch comprises a non-volatile memory that safeguards the content of the day counter or an initialization circuit, the operation of manually date setting the watch is similar in both cases. This operation consists in rotating the hour hand with crown 16 in correction position 16' as many times 24 hours as is needed for the numerical indication of the day of the month to tally with date $D_R$. As such a date setting operation can be rather time consuming, a faster way will be described later. The watch must then, of course, be time set in the usual way.

Initialization circuit 100, which will now be described, only becomes operative in the watch when changing a cell; the rest of the time it is in a wait condition. Circuit 100 comprises a two-input AND gate 105, a two-input OR gate 118, a sequential circuit 119 that generates logic control signals and a discrimination circuit 120 that produces a discrimination signal S120 when the cell is changed during the month after the watch has stopped.

One input of AND gate 105 is connected to the output of day counter 31 so as to receive monthly signal Sm. The output of gate 105 is connected to one input of OR gate 118 whose output is connected to the counting input of month counter 32. The other input of AND gate 105 receives logic signal $\overline{S}$102 from circuit 119 and the other input of OR gate 118 receives a discrimination signal S120 from circuit 120. Signal $\overline{S}$102 is also applied to the other input of AND gate 104. When the watch is working normally, signal $\overline{S}$102 is high and signal S120 is low. This being so, signal Sm is able to proceed through gates 105 and 118 from the output of counter 31 to the input of counter 32 and the output signal of divider 13 is able to proceed to the input of drive circuit 14 through gate 104, as was assumed earlier.

Sequential circuit 119 contains a bistable flip-flop RS 101, whose set input S is connected to the output of circuit 43 so as to receive detection signal S43 and whose reset input R is connected to contact Z via an inverter 110 so as to receive a signal $\overline{S}z$ that is the inverse of day of the month signal Sz. The output Q of flip-flop 101 issues a signal S101 which is applied to one input of a two-input AND gate 107, the other input of this gate receiving rapid advance signal S13. The output of AND gate 107 issues a signal S107 which is applied to the other input of OR gate 108 whose output, which issues a signal S108, is connected to the input of counter 31. Signal S101 is also applied to the other input of OR gate 106 and to the input of a monostable flip-flop 111 that is responsive to a dropping edge of this signal. The output of circuit 111 is connected to one input of two-input OR gate 103 through a delay circuit that is here made up of a pair of series-connected inverters 112*a* and 112*b*. The other input of OR gate 103 receives detection signal S43. The output of gate 103 issues a signal S103 which is applied to an input of day counter 31 that enables the content of this counter to be set to 1.

Circuit 119 further comprises a second bistable RS flip-flop 102 whose input S is connected to the output of circuit 43 and whose input R is connected to the output of a monostable flip-flop 114. Positioning signal Sy is applied to the input of flip-flop 114 which is responsive to a rising edge of the signal. A two-input AND gate 116, with one input connected to the direct output Q of flip-flop 102 and the other input connected to the output of flip-flop 114, issues on its output a signal S116. And inverse output $\overline{Q}$ of flip-flop 102 issues signal $\overline{S}$102 referred to earlier.

Discrimination circuit 120 contains a memory register 109 which receives signal S31 on one input and signal S101 on a clock input Ck. When signal S101 switches from high to low, the register memorizes the number that is representative of the content of counter 31 at that time. The output of register 109 is connected to the input of a subtractor 113 which generates a signal S113 that is representative of the difference between number 33 and the number memorized by the register. Signal S113 is applied to one input, A, of a two-input comparator 115, the other input, B, receiving signal S31. Comparator 115 generates a signal S115 which is low when the number corresponding to signal S113 is less than or equal to the number that corresponds to signal S31, and which is high otherwise.

Circuit 120 further comprises a two-input AND gate 117 which receives signals S115 and S116 and applies discrimination signal S120 to one input of OR gate 118.

After the watch stops working on date $D_A$, disc 20 carries on displaying the number of the day of the month of that date and non-volatile memory 41 continues to contain the month and year data. The content of day counter 31 is however definitely lost.

The primary purpose of initialization circuit 120 is to bring counter 31 into agreement again with disc 20 after the change of cell on date $D_R$. Circuit 120 operates as follows:

Immediately after fitting in the new cell, with crown 16 in its inner, neutral position, circuit 43 generates detection pulse S43 which contains a short pulse. This signal, on activating transmission circuit 42, transfers the month and year data from the non-volatile memory 41 to month counter 32 and year counter 33 which are thus reset in the state they were in on date $D_A$. Signal S43, on passing through OR gate 103, also sets day counter to 1 a first time. Signal S43 also sets flip-flops 101 and 102, a state in which their Q outputs are high.

The high logic level of signal S101, the result of setting flip-flop 101, is also to be found at the output of OR gate 106 and opens AND gate 26 to signal S13 provided signal Sz is also high, such being the case when disc 20 is not displaying the first day of the month. This state of signal S101 also opens AND gate 107 to signal S13 and register 109 to signal S31.

But signal $\overline{S}$102 is low thereby blocking time base signal S1 by closing AND gate 104 to the output signal of divider 13, and preventing signal Sm from reaching the input of counter 32 by blocking AND gate 105.

Under these conditions, motor 2 and counter 32 do not receive any signal whereas signal S13, on passing through AND gate 26 and OR gate 27, activates motor 23 to rotate disc 20 through N steps, from the position that corresponds to stoppage date $D_A$ to position 1 in which contact Z, on opening, causes signal Sz to switch from high to low. Signal S13 also goes through AND gate 107 and OR gate 108 to increment counter 31 whose content increases from 1 to 1+N. This latter value is introduced into register 109 since its Ck input is high. Had signal Sz initiailly been low, with disc 20 displaying 1 on date $D_A$, this would simply have amounted to the case N=0.

With signal Sz going low on opening contact Z, signal S13 is prevented from going through AND gate 26 and disc 20 is blocked in the 1 position. Signal Sz, on going through inverter 110, also resets flip-flop 101, thereby causing signal S101 to switch from high to low. This transition of signal S101 causes signal S13 to be blocked by AND gate 107, value 1+N to be memorized in register 109, whose Ck input goes low, and a signal containing a short pulse, to be generated by monostable flip-flop 111. The signal generated by flip-flop 111, on passing through OR gate 103, sets day counter 31 to 1 a second time so as to agree with disc 20. This signal is however sufficiently delayed by inverters 112*a* and 112*b* for the setting to 1 of counter 31 to occur after its content 1+N has been memorized in register 109. The quantity 1+N is transferred to the input of subtractor 113 which calculates the number 32−N that corresponds to the day of the month of stoppage date $D_A$. The signal S113 that is generated by subtractor 113 and which is representative of the day of the month thus calculated is applied to input A of comparator 115.

After the change of cell, crown 16 must be moved from its neutral position to its correction position 16'. This operation causes contact Y to open and signal Sy to switch from high to low. This in turn causes AND gate 12 to be blocked to the signal that issues from oscillator 10 and the resetting of the final stages of frequency divider 13.

With crown 16 now in correction position 16', the watch must then be set to date $D_R$. This is done by turning crown 16 thereby to actuate contact X which generates signal Sx, a signal that is made up of a succession of pulses. Each pulse, on passing through OR gate 27, causes disc 20 to move forward one day and, on passing through OR gate 108, increments day counter 31 by one unit. Disc 20 and counter 31 thus remain in agreement. Contact X must be actuated as many times as is needed to rotate disc 20 from position 1 to the position that corresponds to the number of the day of the month in date $D_R$. The content of counter 31 then also corresponds to this number and this information is conveyed by signal S31 to input B of comparator 115.

It will be assumed hereinafter that the cell was changed at latest during the month that follows the month in which the watch stopped, on a day having a lesser number than that of the stoppage day. This means that the cell must be changed within a time interval of 27, 28, 29 or 30 days reckoned from the stoppage day, the actual length of the interval depending on the number of days in the month of date $D_A$. Thus, if the number of the day of the month of date $D_A$ is less than or equal to the day of the month of date $D_R$, this means that the cell was changed in the same month as the watch's stoppage month and that signal S115 at the output of comparator 115 is low. But if the number of the day of the month of date $D_A$ is greater than that of date $D_R$, this means that the cell was changed during the month that followed the stoppage month, with signal S115 being high.

The watch is then time set in the usual way. This is no way affects disc 20 or counter 31.

The watch being now both time and date set, crown 16 may be moved from its correction position 16' to its neutral position.

This operation closes contact Y and hence causes signal Sy to switch from low to high. With signal Sy now high OR gate 12 is opened to the signal issued by oscillator 10 and monostable flip-flop 114 is activated. The activation of flip-flop 114 produces a pulse on the R input of flip-flop 102 and resets the latter. A short pulse is produced at the input of AND gate 116 while the R input of flip-flop 102 is high and its Q output is not yet low. This pulse goes through AND gate 117, to increment counter 32 by one unit and set it to the correct month, only when signal S115 is high, i.e. when the cell was changed during the month that followed the stoppage of the watch. Resetting flip-flop 102 also causes signal $\bar{S}102$ to switch from low to high. This firstly causes AND gate 104 to open to the signal issuing from frequency divider 13 thereby enabling time-keeping circuit 1 to generate time-base signal S1, and secondly causes AND gate 105 to open to monthly signal Sm issuing from counter 31.

Moving crown 16 back to its neutral position, thereby restoring time-base signal S1, enables the watch to be started again and calendar circuit 30 to work normally again since counter 32 is again receiving monthly signal Sm.

The watch described above may usefully further comprise a known time-zoning device involving magnetic positioning. Crown 16 must then be able to move into a second correction position, not shown, in which it can act on part of the first gear-train to move, by an integral number of hours, only the hour hand and to activate contact X, each time the hour hand moves past midnight. Disc 20 moves forward by one whole day and counter 31 is incremented by one unit. In the second correction position of crown 16 contact Y remains closed to enable the watch to carry on working normally.

The time-zoning device, besides the function for which it is designed, further enables, after a change of cell, to date set the watch much more quickly than with conventional time setting. If the watch is provided with a time-zoning device that enables the hour hand to be rotated in both directions, the second motor should also be able to rotate in both directions, i.e. be bidirectional. Control mechanism 3 should then have means, not shown but known, e.g. contacts, that are associated with a circuit and which apply a logic signal that discriminates between the directions of rotation of the crown to an input not shown of circuit 28, and to an input not shown of counters 31, 32 and 33. One logic level of this signal would correspond to forward rotation of the motor, causing disc 20 to advance, and to incrementation of the counters, whereas the other logic level would correspond to backward rotation of the motor and to decrementation of the counters. The day of the month displayed by disc 20 would, under the above conditions, always agree with the contents of counter 31, whatever the direction of rotation of the hour hand at the time contact X is actuated, in response to rotation of crown 16 while in a correction position.

With bidirectional motor 23 it is best to use an initialization circuit that enables the watch, after a change of cell, to be date set in the most direct way, i.e. by rotating crown 16 in the direction that involves the least number of jumps for disc 20.

The watch could also be time set electronically, instead of mechanically, by signals generated by a time setting circuit, not shown but known, that activates first motor 2 in response to rotation of crown 16. To facilitate this operation, motor 2 should also be bidirectional.

We claim:

1. An electronic watch comprising:

a time-keeping circuit for generating a time base signal and a rapid advance signal having a frequency greater than that of the time base signal;

a first motor activatable off the time base signal;

a daily contact activatable by the first motor at the end of each day to generate a daily signal;

analog time-display means arranged to be driven by the first motor;

a corrector member having an inoperative position and an operative position in which the indications given by said time display means may be modified;

means coupled with said corrector member and arranged to generate a logic positioning signal, with one level of said signal being representative of the inoperative position of said member and the other level of said signal being representative of the operative position of said member;

a perpetual calendar circuit including day, month and year counters connected in series and activatable by the daily signal, and means responsive to the state of the month and year counters to put the day counter, at the end of 31-day months, in a state corresponding to the first day of the following month, in which state the day counter is arranged to generate a monthly signal;

a second motor;

analog day of the month display means arranged to be driven by the second motor;

means activatable by the second motor to generate a day of the month signal whenever the day of the month is the first day of a month;

a circuit for controlling the second motor and arranged to issue to the latter, in response to the daily signal, to the monthly signal, to the day of the month signal and to the rapid advance signal, a control signal to enable the second motor to alter, at the frequency of the rapid advance signal, the day of the month display by a number of days N such as to display the first day of the month, and increment the day counter to N+1 counts, and for subsequently correcting the day of the month display; and a cell for energizing the electronic circuitry; said watch further comprising:

a reprogrammable non-volatile memory;

a first transmission circuit coupled to the month and year counters to transfer into the non-volatile memory the contents of said counters at the end of each month and of each year respectively;

a detection circuit arranged to generate a detection signal upon replacement, on a replacement date, of the cell that caused the watch to stop on a stoppage date;

a second transmission circuit for transferring, in response to the detection signal, the contents of the non-volatile memory into the month and year counters; and an initialization circuit arranged to receive the detection signal, the day of the month signal, the positioning signal, the rapid advance signal and the signal N+1 representative of the contents of the day counter, and arranged to issue, in response to the positioning signal generated by the motion of the corrector member from its operative position to its inoperative position after subsequently correcting the day of the month displayed by said analog mens, a discrimination signal based on a comparison of said displayed corrected day of the month and the day 32−N representing said stoppage date to the month counter such as to increment the latter by one unit when the day of the month on which the cell is replaced is less than the day of the month on which the watch stopped, whereby the month counter may indicate the correct month should the cell be replaced within twenty-seven, twenty-eight, twenty-nine or thirty days reckoned from the date of stoppage of the month.

2. A watch as in claim 1, wherein the initialization circuit comprises:

a sequential circuit arranged to receive the detection signal, the date of the month signal, the positioning signal and the rapid advance signal and to generate control signals; and a discrimination circuit connected to the sequential circuit and to the day counter and arranged to issue said discrimination signal to the month counter.

3. A watch as in claim 2, wherein the discrimination circuit comprises:

a register connected to the day counter and able to memorize a number N+1 representative of the day of the month on which the watch stopped in response to one said control signal for the sequential circuit triggered by the day of the month signal;

a subtractor connected to the output of the register for deriving the day of the month on which the watch stopped;

a comparator connected firstly to the subtractor and secondly to the day counter and arranged to generate, after setting the date of the watch to correspond to the cell replacement date, a logic signal having one logic state when the day of the month in the cell replacement date has a lower number than the day of the month of the watch stoppage date, and another logic state when the day of the month in the cell replacement date has a higher number or a number that is equal to the day of the month in the watch stoppage date; and means arranged to receive a control signal from the sequential circuit and the signal from the comparator and to issue said discrimination signal to the month counter.

4. In an electronic battery cell-operated watch of the type having a perpetual calendar circuit which includes a day counter, month counter and year counter, said counters connected together to reset the day counter to the first day of the month at the end of 31 days, a motor-driven analog day of the month display for displaying each day of the month, a circuit for correctly resetting said day, month and year counters when said battery cell is replaced comprising:

a reprogrammable non-volatile memory for storing the most recent count of said month and year counters;

a transmission circuit for transferring the contents of said non-volatile memory into said month and year counters when said battery cell is replaced with a new battery cell;

circuit means connected to advance said analog date display from a day DA said battery cell failed, N days to a reference day of the month, and store in said days counter a count representing said N days, and for subsequently advancing said analog date to display a new day Dr representing the day the battery is replaced, and advancing said counter to a count representing said new day Dr;

register means for receiving said count representing said N days said day display was advanced prior to displaying said new day Dr;

a subtractor circuit for computing from said register means said day DA;

a comparator circuit for generating a signal for advancing said monthly counter by one when said subtractor number DA is greater than said day counter number Dr.

5. The electronic watch of claim 4 wherein said reference date is the first day of the month.

6. The electronic watch of claim 5 wherein said number in said day counter representing said N days is N+1.

7. The electronic watch of claim 6 wherein said subtractor computes the number DA as 32−N

* * * * *